US007610857B1

(12) United States Patent
Dunnam et al.

(10) Patent No.: US 7,610,857 B1
(45) Date of Patent: Nov. 3, 2009

(54) BALLISTIC TRACER PLATFORM FOR SHOTGUN AMMUNITION

(76) Inventors: James Alfred Dunnam, 7113 Barefoot Cove, Austin, TX (US) 78730; Mauricio F. Quintana, 58 W. Sienna Pl., The Woodlands, TX (US) 77382

( * ) Notice: Subject to any disclaimer, the term of this patent is extended or adjusted under 35 U.S.C. 154(b) by 0 days.

(21) Appl. No.: 11/894,063

(22) Filed: Aug. 20, 2007

Related U.S. Application Data

(63) Continuation-in-part of application No. 10/932,667, filed on Sep. 4, 2004, now abandoned, which is a continuation-in-part of application No. 10/656,471, filed on Sep. 5, 2003, now Pat. No. 7,228,801.

(51) Int. Cl.
*F42B 12/38* (2006.01)

(52) U.S. Cl. ..... 102/458

(58) Field of Classification Search ..... 102/430, 102/448–449, 457–459
See application file for complete search history.

(56) References Cited

U.S. PATENT DOCUMENTS 1,363,043 A * 12/1920 Jewett ..... 102/458
3,142,254 A * 7/1964 Grinzenberger ..... 102/458
4,553,481 A * 11/1985 Ricci ..... 102/458
4,706,568 A * 11/1987 Lundwall et al. ..... 102/513
4,895,076 A * 1/1990 Looger et al. ..... 102/439
5,235,915 A * 8/1993 Stevens ..... 102/439
6,990,905 B1 * 1/2006 Manole et al. ..... 102/513
7,228,801 B2 6/2007 Dunnam

FOREIGN PATENT DOCUMENTS

WO WO 94/23264 * 10/1994

* cited by examiner

*Primary Examiner*—David J Parsley
(74) *Attorney, Agent, or Firm*—Mary J. Gaskin

(57) ABSTRACT

A ballistic tracer platform for use with a shotgun shell to provide an aiming and training aid for shotgun shooting sports, which also can be used for military and police applications. The ballistic tracer platform emits light after ignition of the shell, providing the shooter with a consistent reference to make corrections to his aiming point and shooting techniques. The tracer platform can be used in ordinary shotgun shells. The tracer platform comprises a translucent, resilient, elastic, cylindrical container in which the reactants, a fluorescent colored dye and oxalate solution and an activator, are held, separated from each other prior to ignition by encasing one or both in its own glass bulb or tube. The blast from ignition of the shell causes the glass bulb(s) or tube(s) to break. The resulting chemiluminescent reaction between the reactants results in emission of light which is visible to the shooter.

20 Claims, 6 Drawing Sheets

BALLISTIC TRACER PLATFORM FOR SHOTGUN AMMUNITION

FIELD OF THE INVENTION

This application is a continuation in part of application Ser. No. 10/932,667, which was filed on Sep. 4, 2004, which was a continuation in part of application Ser. No. 10/656,471, which was filed on Sep. 5, 2003, and which issued on Jun. 12, 2007 as U.S. Pat. No. 7,228,801 B2. The present invention relates to shotgun ammunition, more specifically tracers used to make the shot visible to shooters.

BACKGROUND OF THE INVENTION

Shotgun sports date back to the late 1700's with the introduction of trap shooting of live pigeons. The sport later evolved with the introduction of clay pigeons in 1880 and the development of reliable clay throwing machines in 1890. The two main types of shotgunning games that evolved are Trap and Skeet. Trap is a game where the clays are thrown from a single location or house, at different random angles while the shooters rotate between five shooting positions. Skeet is a game where clays are thrown from two locations or houses, at consistent trajectories while shooters rotate between eight stations. International trap was introduced as an Olympic Sport in 1952, while International Skeet was introduced as an Olympic Sport in 1968. In Sporting Clays, a third shotgunning game which has been introduced in recent years, clays are thrown from many locations in an attempt to resemble a real life hunt, while shooters walk through a golf course-like field.

All shotgun sports require the shooter to accurately predict the trajectory of the target. This requires a good understanding of the physics involved, including the speed of the shot and target, the trajectory of the shot and target, the type of shot and the size of the target. To complicate things, shooters need to develop the ability to predict the position of the target and aim their weapons appropriately so that the shot intersects the target. This drives the need to shoot the clay by leading it. The lead is defined as the distance in front of the target, which the shooter aims and shoots at in order to break the target. This lead will vary depending on the game, target speed, shot type, shot speed, shooters technique, and atmospheric conditions; it can range from a few inches to more than ten feet.

The greatest challenge in shotgunning sports is mastering the lead. The supersonic nature of the shot, with speeds ranging from approximately 900 to 1500 ft/s (274 to 457 m/s), and the speed of the target, ranging from approximately 40 to 70 miles/h (64 to 112 Km/h), make it almost impossible for the shooter to know where his shot has gone relative to the target. To further complicate accurate aiming, the human brain and eye refresh images approximately every 0.1 seconds, while the average shot flight time to the target is approximately 0.05 to 0.30 seconds. This makes the game a real challenge to learn, and very difficult and time-consuming to master.

The visibility of an object to the human eye generally depends on the size of the object, the relative distance between the object and the observer, the relative speed of the object, the color of the object, and the light intensity and atmospheric conditions. Inventors have developed tracers for shotgun shells in an attempt to aid the shooter in visualizing his or her shot with regard to the target.

Prior tracers can be categorized as non-ignition and ignition type. Non-ignition type inventions have been unsuccessful in the shooters market; they include:

(a) Pellet with fluorescent tails (U.S. Pat. No. 3,760,735 to P. F. Schmitt in 1971);

(b) Shot encapsulated with light reflective coating (U.S. Pat. No. 4,080,899 to W. L. Luban in 1978);

(c) Chemiluminescent tracer that accompanies the shot (U.S. Pat. No. 4,553,481 to V. Ricci in 1984); and (d) Shotgun shell flight path indicator (U.S. Pat. No. 6,539,873 to E. W. Diller in 2003).

Ignition type inventions although promising have had very limited success in the market place, these include:

(a) Single bullet-shaped tracer projectile with pyrotechnic mixture in the trailing end (U.S. Pat. No. 3,405,638 to J. A. Stoner in 1968);

(b) Shot pellets coated with ignitable illuminat or smoking agent (U.S. Pat. No. 4,389,939 to H. Ofuji in 1983);

(c) Single ball-shaped tracer projectile with pyrotechnic mixture in the trailing end (U.S. Pat. No. 4,841,866 to D. W. Miesner in 1989); and (d) Tracer cartridges (U.S. Pat. No. 5,429,054 to R. E. Topping in 1995).

The ignition type designs available today are mostly derived from U.S. Pat. No. 3,406,648 and U.S. Pat. No. 4,841,866. The marginal success of these inventions can be attributed to the high price charged and the clear fact that these inventions do not function properly. Currently available tracers, while visible, do not provide the shooter with a consistent reference to improve his or her shooting. Typical reasons tracers fail include the following:

(a) The tracer does not have a flight pattern consistent with that of the shot and therefore fails to provide the shooter with an appropriate reference.

(b) The tracer fails to ignite consistently because the pyrotechnic material does not have enough time and surface area to absorb heat from the propellant blast as it separates from the shot cup.

(c) Current tracer inventions have limited, if any, applicability to smaller shotgun gauges because of the geometric constraints in the smaller gauges like 16, 20, 28, and 410.

More specifically, currently available tracers fail because the tracer projectile travels randomly with the shot pattern. Manufacturers claim that the tracer projectile travels in the middle of the shot pattern, but field tests prove otherwise. The point of impact at 22 yards of currently available tracer projectiles is no more predictable than any single pellet within the shot cloud. Field tests indicate that currently available tracers provide 30 to 44 inch groups from the point of aim (and the tracer pellet most often impacts outside the shot string), even though shotgun sports require a 12 inch group, or better, to be effective. The inaccuracy of current tracer designs stems from the fact that the tracer projectile is located at the bottom of the shot cup. Once fired, the tracer is subjected to the chaotic behavior and interference of the supersonic gases, shot and wad as it leaves the barrel and travels to the target. These interferences present the greatest challenge in designing an effective shotgun tracer. An improved tracer design should address these interferences and should still be capable of carrying the proper amount of shot within the constraints of standard shotgun cartridges.

Previously, the inventors of the present application filed a patent application for a ballistic tracer platform holding pyrotechnic tracer material, which has issued as U.S. Pat. No. 7,228,801 B2. In a continuation-in-part application, of which the present application is a continuation-in-part, applicants disclosed a novel platform holding chemiluminescent materials.

SUMMARY OF THE INVENTION

The present invention provides a ballistic tracer platform holding tracer material which, when loaded into a shotgun shell, can be used to provide a shooter with a consistent reference, allowing him or her to make appropriate corrections to his or her shooting technique. This invention serves as a training aid to improve a shooter's accuracy for shotgun sports such as Trap, Skeet, or Sporting Clays. It also serves as a shotgun aiming and training aid for hunters, as well as having training and combat applications for military and police personnel. The invention enables the shooter to visualize the shot with respect to the target by firing the tracer ammunition in a manner identical to that of standard ammunition. The invention incorporates the known components of a chemiluminescent reaction. The invention described herein can be modified and adjusted for use with all shot types, and it can be used in all shotgun gauges, including 4, 8, 10, 12, 16, 20, 28, and 0.410, in both single and double barrel shotguns.

In accordance with the present invention a shotgun tracer shell comprises a tracer platform with a ballistic coefficient equivalent to that of the shot pellets with which it is used. The platform comprises a transparent or translucent cylindrical container holding liquid reactants which, when mixed, cause a chemiluminescent reaction, resulting in the emission of light. The container is made from a resilient, elastic, transparent or translucent material, such as polypropylene, polyethylene, polycarbonate, or nylon. Helical grooves may be added to the platform surface to spin the tracer platform as it leaves the barrel and travels towards the target. The diameter, length, weight and shape of the tracer platform can be modified to match the flight characteristics of each particular shotgun gauge, shot type, and speed. The ballistic tracer platform can be manufactured from readily available materials using standard high volume processes, including injection molding or screw machines. The simplicity of the invention will enable effective and efficient quality control procedures in the manufacturing process.

In another embodiment, the ballistic tracer platform can be loaded into a shell, above the shot cup, separated therefrom by a spacer.

In other embodiments, the ballistic tracer platform can be loaded into a shell, above a space-filler, which replaces the shot cup, or it can be positioned in the shot cup of a standard shotgun wad, with no shot below the platform. After ignition, this tracer platform serves as a reference, or indicator, for a shooter.

In yet another embodiment, the ballistic tracer platform can be manufactured with an integrated shot cup which separates as soon as the platform leaves the shotgun barrel, without interfering with the trajectory of the shot and tracer platform.

The ballistic tracer platform is used to carry the components of a chemiluminescent reaction: an activator, such as hydrogen peroxide, and an oxalate, such as phenyl oxalate ester, as well as a colored fluorescent dye solution. The reactants are separated by having either one or both of the reactants contained inside a frangible glass vessel, which breaks when the shell is fired, allowing the reactants to mix. The resulting reaction causes the release of energy to the fluorescent dye, exciting its atoms, resulting in the release of energy as light, which makes the platform easy for the shooter to see.

It is an object of the present invention to provide a platform for holding tracer material so that the platform has an accurate, predictable, and centered trajectory to the shot string, without interference from the shot's trajectory.

Another object of the present invention is to provide a means by which the chemiluminescent reaction can proceed quickly and consistently, resulting in a clearly visible projectile, even during daylight hours.

Yet another object of the present invention is to provide a tracer platform which can be adjusted to match the flight characteristics of each particular shotgun gauge, shot type, and speed.

Still another object of the present invention is to provide a tracer platform which is safe to use, with no risk of fire; the chemiluminescent reaction occurs without generating significant amounts of heat.

A further object of the present invention is to provide a tracer platform which is inexpensive and easy to produce.

Further objects and advantages of this invention will become apparent from a consideration of the drawings and description, infra.

BRIEF DESCRIPTION OF THE DRAWINGS

FIGS. 10A-9D are sectional side views showing the positions of the ballistic tracer platform before and after ignition.

DESCRIPTION OF THE PREFERRED EMBODIMENT

The present invention is designed to be used with a typical shotgun shell 1, which generally has a hull 2 with a metal base cap 3 and a crimped top 4.

Figure 1:
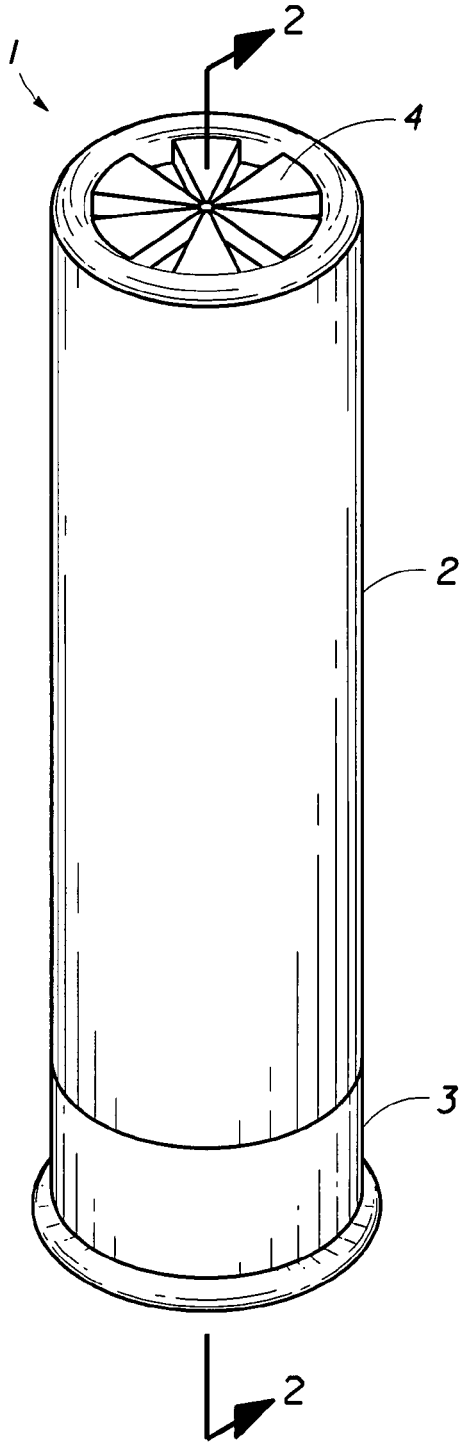
FIG. 1 is an isometric view of a shotgun shell containing the ballistic tracer platform of the present invention.
Figure 2:
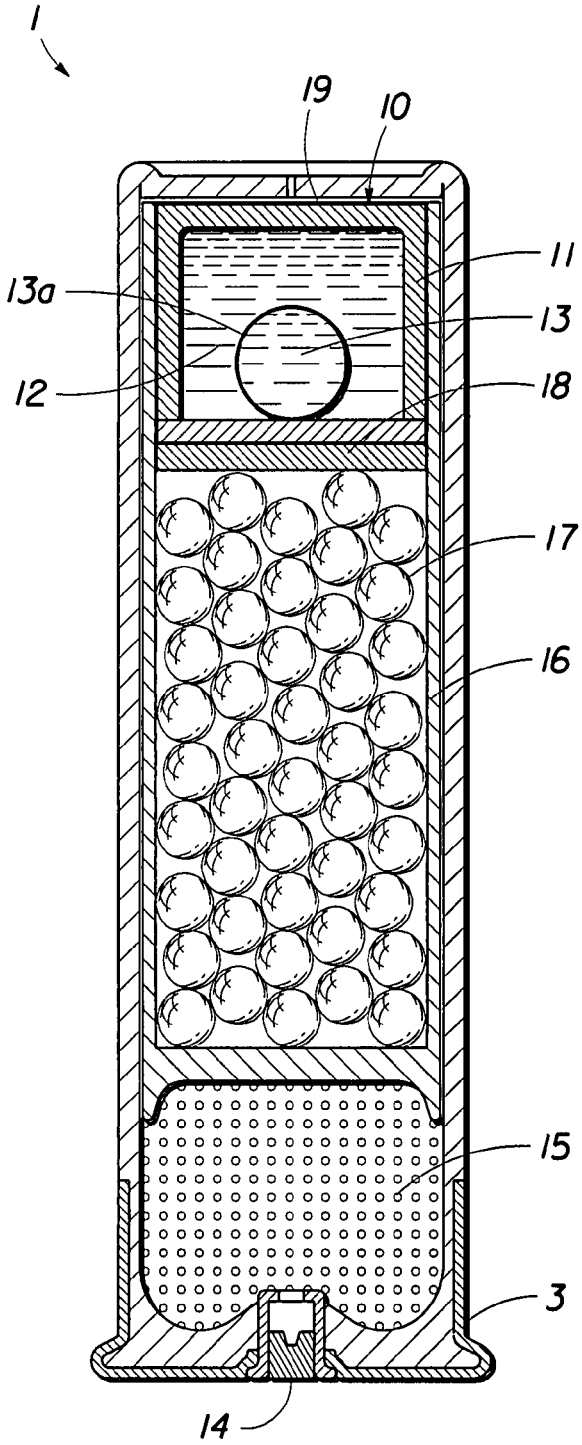
FIG. 2 is a sectional side view of the shotgun shell containing the ballistic tracer platform illustrated in FIG. 1 taken along line 2-2.

The sectional view in FIG. 2 shows a shotgun shell 1 which has been assembled with the ballistic tracer platform 10, located inside the upper end of the shotgun shell 1. The ballistic tracer platform 10 comprises a cylindrical container 11 holding: (1) an oxalate solution with a colored fluorescent dye solution (hereinafter called "oxalate-fluorescent dye solution 12"), and (2) a glass-encased activator 13. Inside the base cap 3 is the primer 14, which ignites the propellant 15 contained in the lower end of the shotgun shell 1. Located above the propellant 15 is the shot cup 16 (or shot holder), which has been partially filled with shot pellets 17. The shot pellets 17 can be conventional lead or steel pellets or lighter shot such as plastic BB's. The shot cup 16 can be formed to have a gas seal at its lower end, as shown, in order to contain the gases during their expansion after the propellant 15 has been ignited. Alternatively, a gas seal can be constructed as a separate piece and placed below the shot cup 16. A disk-shaped spacer 18, made of plastic, cardboard, or cork, is loaded into the shot cup 16 above the shot pellets 17, in order to protect the ballistic tracer platform 10 from the shot pellets 17. The ballistic tracer platform 10 is loaded into the shot cup 16 above the spacer 18.

The ballistic tracer platform 10 can have a flat nose 19, as shown, or it can have a nose shaped to alter the ballistic properties of the ballistic tracer platform 10. The ballistic tracer platform 10 can be adjusted in size, shape, and materials used, depending on the shotgun gauge used; it can perform with different applications and shot types. The ballistic tracer platform 10 can be made with a diameter ranging from 0.2 inches to 1.25 inches, depending on the bore size for the shotgun in which it will be used; it can be used in all shotgun gauges, including 4, 8, 10, 12, 16, 20, 28, and 0.410, in both single and double barrel, and semi-automatic shotguns. The container 11 of the ballistic tracer platform 10 is made from a resilient, elastic material that: (1) can withstand the high pressures from expanding gases and inertial forces; (2) deforms as a result of those forces, yet regains its essential shape in flight; (3) does not degrade the materials contained therein; and (4) is transparent or translucent enough to allow light emitted from the reaction to be visible to the shooter. Examples of such a material include plastics such as polypropylene, polyethylene, polycarbonate, and nylon. In all cases, the bottom of the container 11 is preferably transparent or clear. Alternatively, a polypropylene or polyethylene container 11 can be partially encased in nylon or another high-strength plastic, composite material, or even metal, with the transparent bottom of the container 11 exposed. The container 11 of the ballistic tracer platform 10 can be made by injection molding.

The oxalate-fluorescent dye solution 12 typically contains phenyl oxalate ester, and the activator 13 is often a hydrogen peroxide solution ($H_2O_2$). The proportions of the reactants can vary, depending on the type and quality of materials used, as well as the application. The reaction was tested successfully with a 1:1 proportion. The fluorescent dye in the oxalate-fluorescent dye solution 12 makes the ballistic tracer platform 10 highly visible after ignition and reaction. The fluorescent dye used can be of any visible color, including red, orange, yellow or yellow-green. Known flourescent dyes include the following: 5,12-bis(phenylethynyl) naphthacene and rubrene (red); 2-chloro, 9,10-bis(phenylethynyl) anthracene, 1,5-dichloro- and 1,8-dichloro-9,10-bis(phenylethynyl) anthracene (yellow); 9,10-bis(phenylethynyl) anthracene (BPEA) and 1-chloro-9,10-bis(phenylethynyl) anthracene (yellow-green); and perylene and 9,10-diphenyl anthracane (blue). As shown in FIG. 2, the activator 13 is encased in a frangible spherical glass bulb 13*a*, which was formed by glass molding and filled by using a standard vacuum filling process or a liquid injection process. The oxalate-fluorescent dye solution 12 fills the rest of the container 11. Optionally, the oxalate-fluorescent dye solution 12 can be held in a second frangible glass bulb. After the oxalate-fluorescent dye solution 12 and the activator 13 are placed in the container 11, the parts of the container 11 are joined by automated screwing processes (if threads are used) or by ultrasonic welding or gluing. The ballistic tracer platform 10 can be introduced into standard shotgun shells by using existing loading processes.

Positioning the tracer platform 10 in front of the shot pellets 17 removes it from direct contact with the blast from the ignited propellant 15, resulting in lower forces and stresses to the platform 10, compared to the embodiment disclosed in the patent application. Further, the shot holder 16 partially absorbs "spike" forces created by the blast. The elastic characteristics of the container 11 allow it to recover its original shape and dimensions after it has been fired from the shotgun and is in flight.

Figure 3:
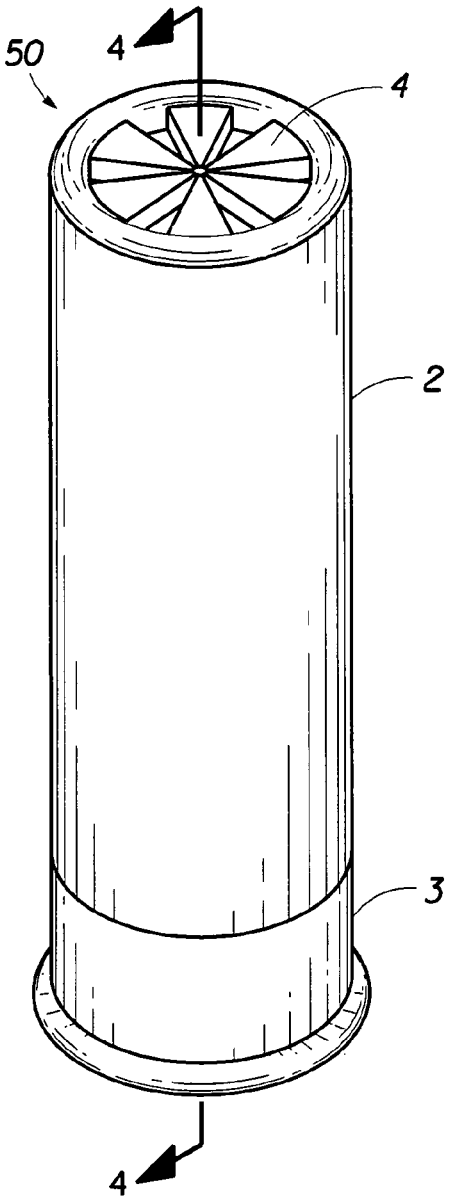
FIG. 3 is an isometric view of a alternative shotgun shell containing the ballistic tracer platform of the present invention

Shown in FIG. 3 is an alternative shotgun shell 50, which generally has a hull 2 with a metal base cap 3 and a crimped top 4.

Figure 4:
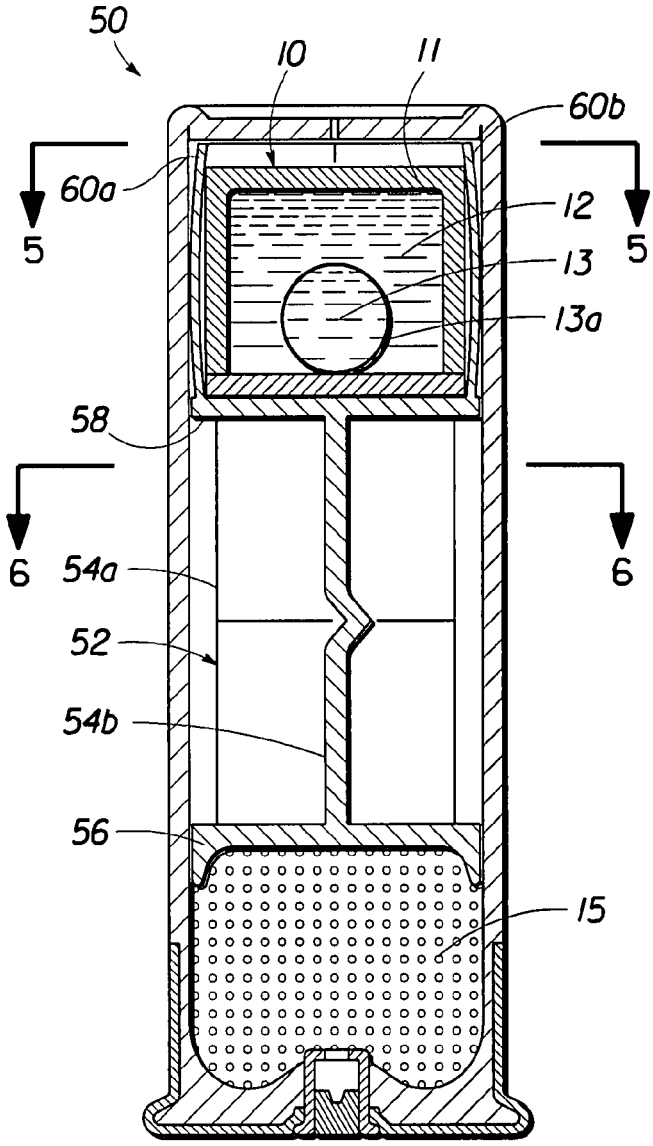
FIG. 4 is a sectional side view of the alternative shotgun shell containing the ballistic tracer platform illustrated in FIG. 3 taken along line 4-4.

As shown in FIG. 4, when used with the alternative shotgun shell 50, the ballistic tracer platform 10 can be loaded into a conventional wad 52 without any shot pellets, particularly when a shooter wishes to fire it merely as an indicator or reference. When this embodiment is assembled, a cylindrical wad 52, made from polypropylene, polyethylene, or another high-strength plastic, is placed in the shell 50 above the propellant 15. The wad 52 is typically formed with shock-absorbing compression columns 54*a*, 54*b* and has a gas seal 56 formed in its lower end. The tracer platform 10 is then placed into the wad shot holder 58, inside the petals 60, which cushion the tracer platform 10 during ignition and which open and fall away when the tracer platform 10 is in flight.

Figure 5:
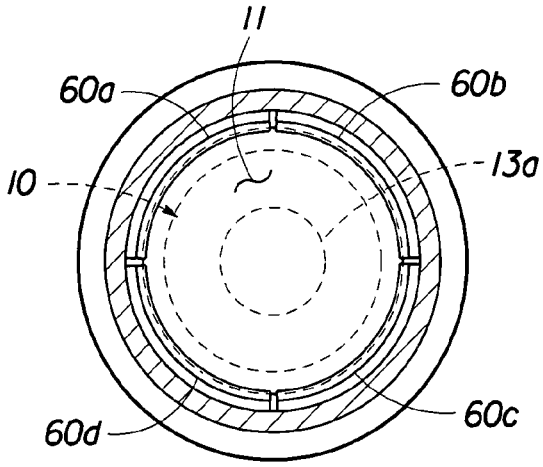
FIG. 5 is a cross-sectional view of the top of the alternative shotgun shell containing the ballistic tracer platform illustrated in FIG. 4 taken along line 5-5.

FIG. 5 shows the container 11 inside the petals 60*a*, 60*b*, 60*c*, 60*d* of the wad 58.

Figure 6:
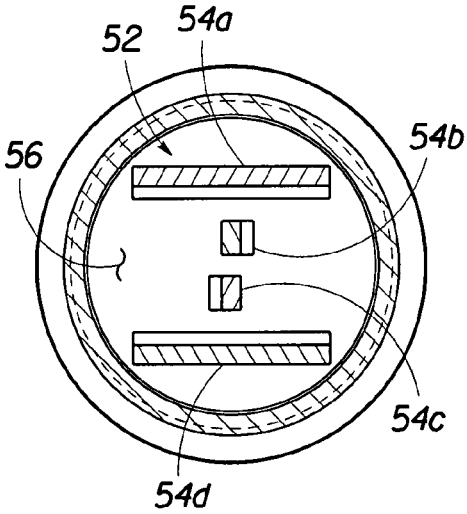
FIG. 6 is a cross-sectional view of wad inside of the alternative shotgun shell containing the ballistic tracer platform illustrated in FIG. 4 taken along line 6-6.

FIG. 6 shows the shock-absorbing compression columns 54*a*, 54*b* of the wad 58, as well as the gas seal 56.

Figure 7:
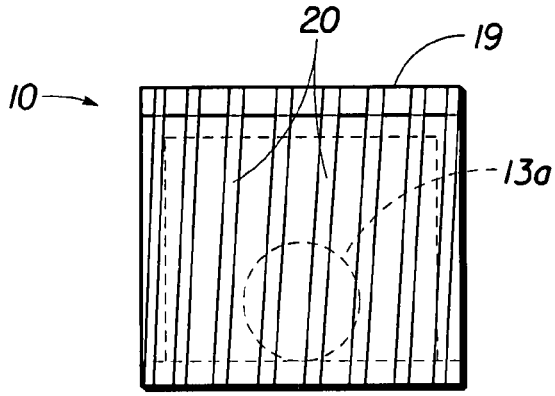
FIG. 7 is a side view of the ballistic tracer platform modified by forming helical grooves on its outer surface to cause spin.

FIG. 7 shows a ballistic tracer platform 10 with a flat nose 19 and helical grooves 20 (different shapes and angles can also be used) formed on its surface to add spin to the ballistic tracer platform 10.

Figure 8:
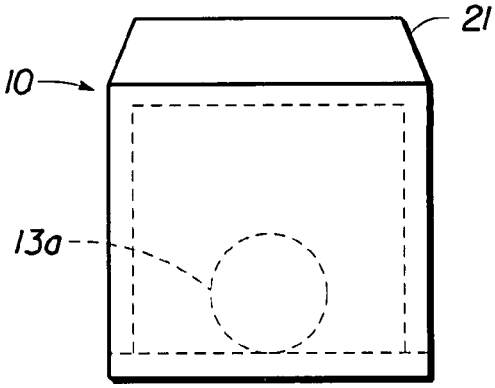
FIG. 8 is a side view of the ballistic tracer platform with a modified cone-shaped nose for improved ballistic performance.

As shown in FIG. 8, an alternate embodiment of the ballistic tracer platform 10 has a flat-conical nose 21 to improve its ballistic performance. Alternatively, the nose 21 could be spherical or conical in shape.

Figure 9:
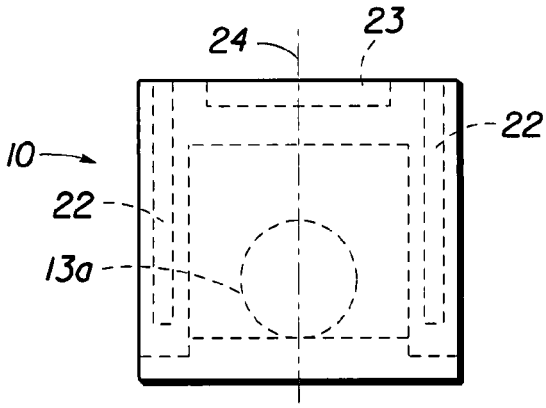
FIG. 9 is a side view of the ballistic tracer platform modified by the addition of symmetrically-spaced cavities, which can be filled in order to change the weight of the platform.

FIG. 9 shows a ballistic tracer platform 10 with cavities 22 and a top cavity 23, to which can be added materials having densities different from that of the ballistic tracer platform 10 itself. The cavities 22, 23, which must be located symmetrical to the longitudinal axis or centerline 24, allow the manufacturer to adjust the weight and flight characteristics of the ballistic tracer platform 10. The number, size, shape, and placement of the cavities 22, 23 used will depend on the size of the ballistic tracer platform 10 and its application.

Other embodiments of the ballistic tracer platform 10 could be made. For instance, the ballistic tracer platform 10 could be made with fins. Small indentations can be made on its surface to reduce air drag. Orifices can be formed on its surface to create additional spin of the ballistic tracer platform 10. A shot cup could be manufactured as an integral of the ballistic tracer platform 10, designed to separate once the ballistic tracer platform 10 leaves the barrel of the shotgun, without interfering with the trajectory of the shot and ballistic tracer platform 10.

FIGS. 10A-10D show the movement of the ballistic tracer platform 10, before and after ignition.

Figure 10A:
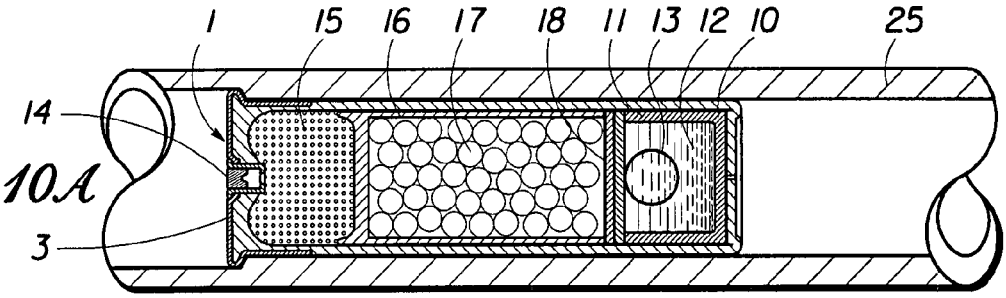

In FIG. 10A, the shotgun shell 1, containing a shot cup 16 with shot pellets 17, has been loaded into the shotgun barrel 25. The ballistic tracer platform 10 holds the oxalate-fluorescent dye solution 12 and the activator 13 in the resilient, elastic container 11. The primer 14 will ignite the propellant 15, and gasses will expand against the lower end of the shot cup 16.

Figure 10B:
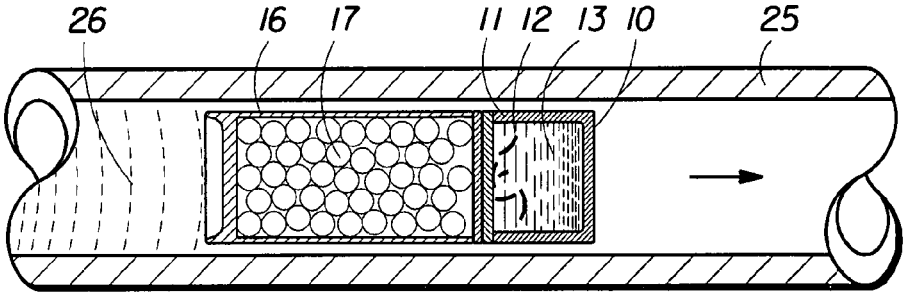

In FIG. 10B, the explosive movement of the expanding gases 26 of ignition propel the shot cup 16 with shot pellets 17, and the ballistic tracer platform 10 holding the reactants, through the shotgun barrel 25, simultaneously breaking the glass container holding the activator 13, allowing the activator 13 to mix with the oxalate-fluorescent dye solution 12 in the container 11. The reaction results in the release of energy and excitation of the atoms in the fluorescent dye, resulting in the release of light, or photons (the process of "chemiluminescence"), making the platform 10 highly visible to the shooter.

Figure 10C:
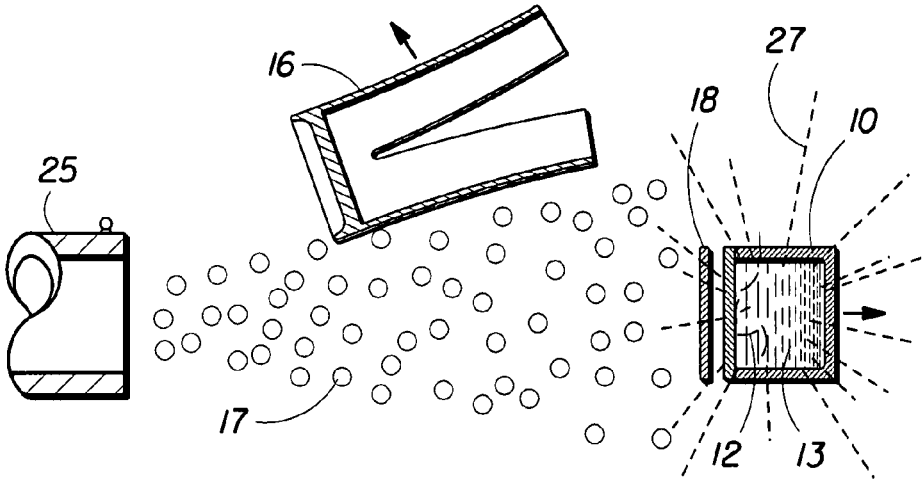

In FIG. 10C, after leaving the shotgun barrel 25, the shot cup 16 has flipped out of the way of the scattering shot pellets 17. The transparent or translucent ballistic tracer platform 10, carrying the reacting oxalate-fluorescent dye solution 12 and activator 13 and emitting visible luminescence 27, is located in front of the shot pellets 17 and spacer 18. The "color" of the platform 10 depends on the color of the fluorescent dye used.

Figure 10D:
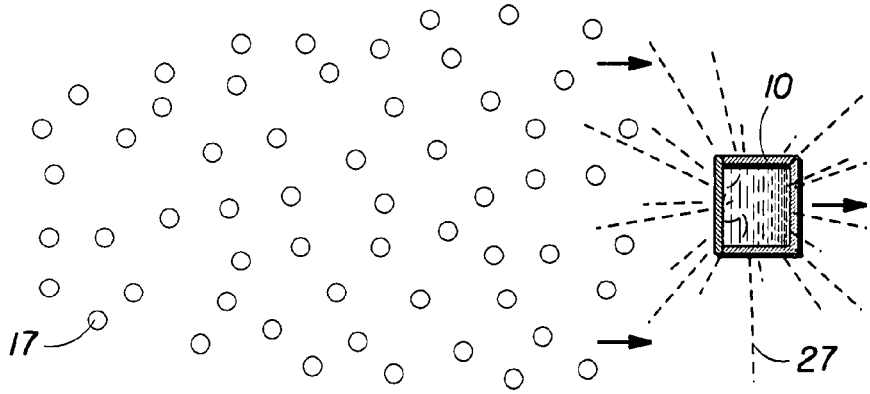

As shown in FIG. 10D, the ballistic tracer platform 10, which continues to emit luminescence 27, remains in front of the shot pellets 17 as they travel and expand.

Figure 11:
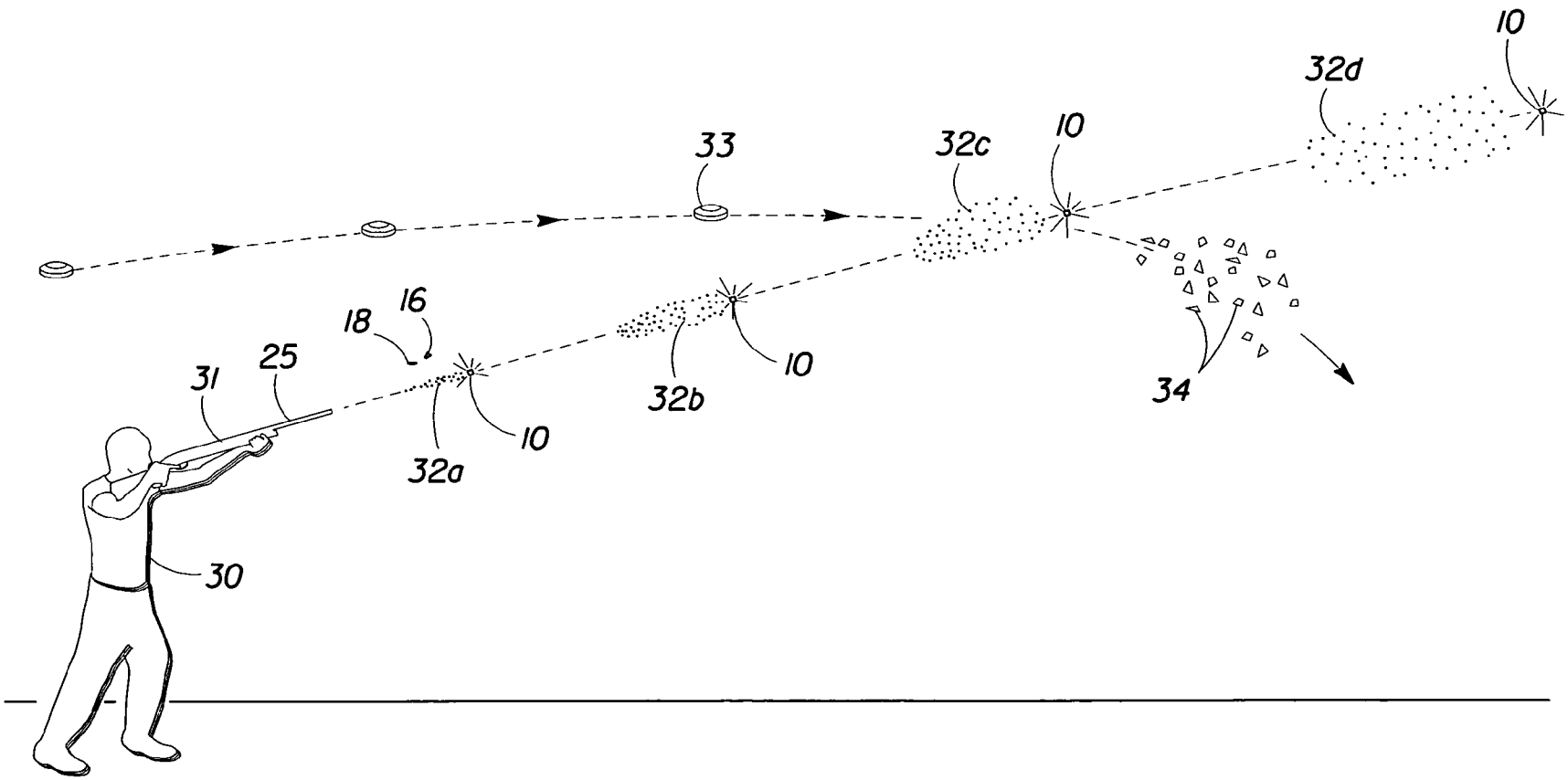
FIG. 11 is a representational view of a shooter using the ballistic tracer platform of the present invention while shooting at a clay target.

FIG. 11 shows a shooter 30 using the ballistic tracer platform 10 of the present invention. The shooter has loaded his shotgun 31 as he would load any other ammunition. The shooter has aimed in front of the clay target 33 and has fired. The ballistic tracer platform 10 has left the shotgun barrel 25 as the patterns of the shot string 32A, 32B, 32C, 32D expands, the ballistic tracer platform 10 remains in front of the shot pellets in the shot string 32. (The shot cup 16 has flipped out of the way and the spacer 18 has fallen.) If the shooter 30 hits the clay target 33, it breaks into pieces 34. If he misses the clay target 33, the shooter 30 would correct his lead or aiming point, according to the relative position of the ballistic tracer platform 10 to the clay target 33. For example, if the ballistic tracer platform 10 is behind the clay target 33 and the clay target 33 is missed, the shooter 30 would need to aim further ahead of the clay target 33 in order to break it. In some cases the shooter 30 can benefit from having a shooting partner who would help confirm the position of the ballistic tracer platform 10 relative to the missed target 33.

Figure 12:
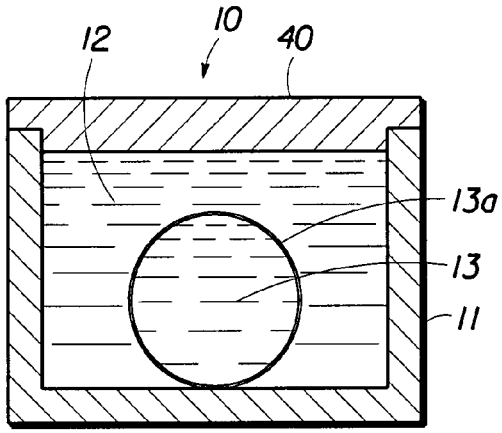
FIGS. 12 through 15 are sectional side views, each showing a different way of assembling the ballistic tracer platform, which contains the reactants, which must be kept separate prior to ignition, and which, when combined after ignition, result in a chemiluminescent reaction.

FIG. 12 is a sectional side view showing a typical method of assembling the ballistic tracer platform 10 of the present invention. The liquid activator 13, such a hydrogen peroxide solution, which has been encased in a spherical frangible glass bulb 13*a*, has been placed in the container 11. An oxalate-fluorescent dye solution 12, such as phenyl oxalate ester, to which a colored fluorescent dye solution has been added, herein the oxalate-fluorescent dye solution 12, has been poured into the container to fill it. A lid 40 has been placed on top of the container 11 and joined thereto by ultrasonic welding, threading, or gluing.

Figure 13:
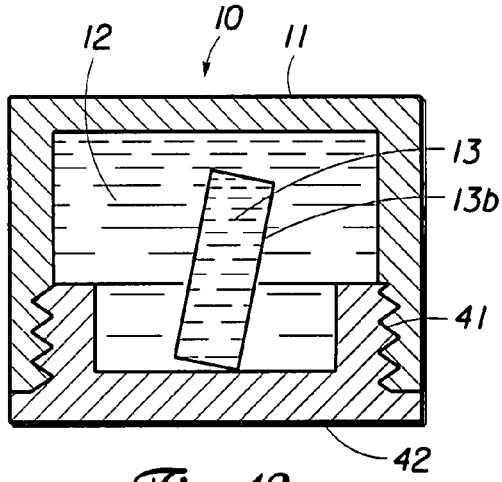

FIG. 13 is a sectional side view showing another method of assembling the ballistic tracer platform 10 of the present invention. The liquid activator 13, which has been enclosed in a cylindrical frangible glass tube 13*b*, has been placed in a container 11 with an inner threaded portion 41. The oxalate-fluorescent dye solution 12 has been poured into the container to fill it. A lid 42 with an outer threaded extension has been screwed onto the inner threaded portion 41 of the container 11 to close it. Here the container 11 has been inverted to show its position as the ballistic tracer platform 10 in the shell 1 of FIG. 2, supra.

Figure 14:
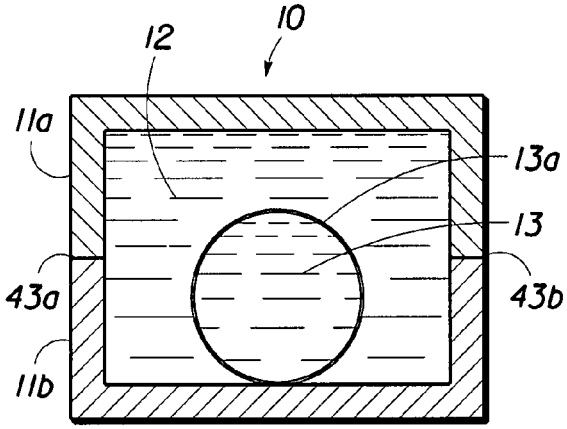

FIG. 14 is a sectional side view showing another method of assembling the ballistic tracer platform 10 of the present invention. The activator 13, which has been encased in a frangible glass bulb 13*a*, has been placed in half-section 11*a*, and identical half-section 11*b* is inverted and loosely placed on top to form the container 11. The container 11 is immersed in oxalate-fluorescent dye solution 12 to fill it. The half-sections 11*a*, 11*b* are pressed together where the edges meet at 43*a*, 43*b*, and sealed by the process of ultrasonic welding, threading, or gluing.

Figure 15:
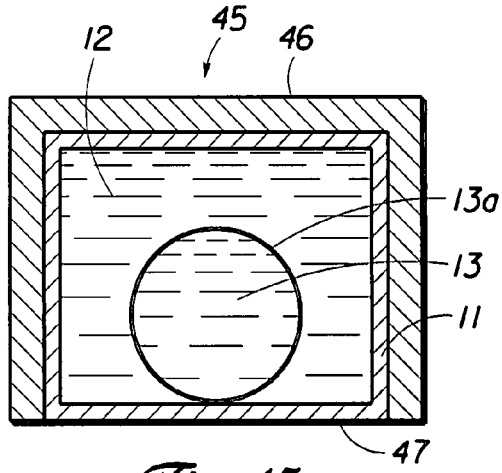

FIG. 15 is a sectional side view showing yet another method of assembling a ballistic tracer platform 45 in accordance with the present invention. Here three sides of the container 11 (made as shown in any of FIGS. 8, 9 and 10), holding the activator 13 and the oxalate-fluorescent dye solution 12, have been encased in a housing 46 made of nylon or another high strength material, resulting in a stronger ballistic tracer platform 45. After ignition, light from the chemiluminescent reaction is emitted through the transparent bottom side 47 of the container 11.

Figure 16A:
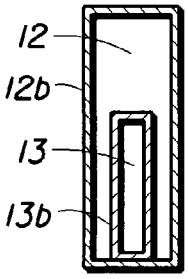
FIGS. 16A through 16D are sectional side views, each showing additional ways of holding the reactants in separate bulbs or tubes within the container prior to ignition of the shell.
Figure 16B:
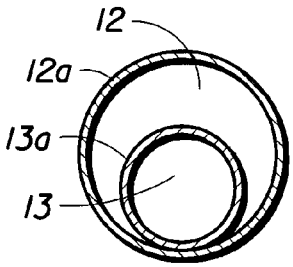
Figure 16C:
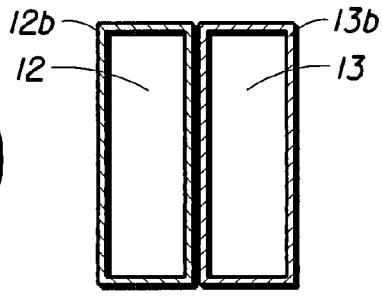
Figure 16D:
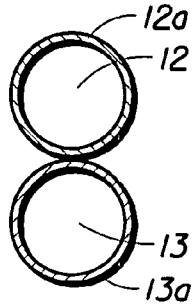

FIGS. 16A, 16B, 16C, and 16D show different possibilities that may be used for separately encasing both the activator 13 and the oxalate-fluorescent dye solution 12 before placing them in the container 10. For instance, in FIG. 16A, the activator 13 is encased in a cylindrical frangible glass tube 13*b*, which is enclosed inside a cylindrical frangible glass tube 12*b* containing the oxalate-fluorescent dye solution 12. In FIG. 16B, the activator 13 is encased in a spherical frangible glass bulb 13*a*, which is enclosed inside a spherical frangible glass bulb 12*a* containing the oxalate-fluorescent dye solution 12. In FIG. 16C, the oxalate-fluorescent dye solution 12 is enclosed in a cylindrical frangible glass tube 12*b*, and the activator 13 is enclosed in a cylindrical frangible glass tube 13*b*. In FIG. 16D, the oxalate-fluorescent dye solution 12 is enclosed in a spherical frangible glass bulb 12*a*, and the activator 13 is enclosed in a spherical frangible glass bulb 13*a*. In all of these instances, the oxalate-fluorescent dye solution 12 and the activator 13 will not be in direct contact with the walls of the container 11 in which they are placed prior to ignition. Therefore, the material used to make the container 11 can be selected from a broader range of materials, such as nylon, which may otherwise tend to react with the activator 13 or oxalate-fluorescent dye solution 12.

Care should be used when storing the shells 1 which contain the ballistic tracer platform 10 of the present invention, since exposure to ultraviolet light could cause the oxalate-fluorescent dye solution 12 and the activator 13 to degrade. For instance, a box of the shells 1 may be enclosed with an opaque material such as aluminum foil, cardboard, or an opaque plastic.

Although the description contains much specificity, these should not be construed as limiting the scope of the invention, but merely providing illustrations of some of the presently preferred embodiments of this invention. Thus the scope of the invention should be determined by the appended claims and their legal equivalents, rather than be the examples given.

We claim:

1. A cylindrical ballistic tracer platform for use with a shotgun shell having a lower end and an upper end, and further having propellant and a shot cup having a first end and an opposing end and holding shot, the propellant being contained inside the lower end of the shotgun shell below the second end of the shot cup, the tracer platform comprising a resilient, elastic, translucent container holding a first reactant, a second reactant, a fluorescent dye, and means for physically separating the first reactant from the second reactant and the fluorescent dye prior to their combination resulting in a chemiluminescent reaction, the tracer platform located inside the upper end directly under the crimped top of the shotgun shell, inside the first end of the shot cup and above the shot held in the shot cup, the tracer platform further comprising a disk-shaped spacer arranged under and adjacent to the tracer platform in order to separate the tracer platform from shot held in the shot cup, the tracer platform moving separately from the shot holder after leaving a shotgun barrel.

2. The ballistic tracer platform of claim 1 wherein the container is made from a material selected from the group consisting of polypropylene, polyethylene, polycarbonate, and nylon.

3. The ballistic tracer platform of claim 1 wherein the first reactant is a hydrogen peroxide solution and the second reactant is a phenyl oxalate ester solution.

4. The ballistic tracer platform of claim 1 wherein the means for physically separating the first reactant from the second reactant and the fluorescent dye comprises at least one frangible glass container.

5. The ballistic tracer platform of claim 1 whereas the tracer platform has a flat, conical, or spherical top side.

6. The ballistic tracer platform of claim 1 wherein the tracer platform has formed therein symmetrical cavities for adjusting the tracer platform's weight and flight characteristics.

7. The ballistic tracer platform of claim 1 wherein the tracer platform has an outer surface with grooves formed therein.

8. The ballistic tracer platform of claim 1 wherein the tracer platform has an outer surface with symmetrically-positioned fins attached thereto.

9. The ballistic tracer platform of claim 1 wherein the tracer platform has an outer surface with orifices formed therein.

10. The ballistic platform of claim 1 wherein the tracer platform further comprises means for partially encasing the container with reinforcing material.

11. The ballistic platform of claim 10 wherein the reinforcing material is selected from the group consisting of nylon, high-strength plastic, composite material, and metal.

12. The ballistic tracer platform of claim 1 wherein the disk-shaped spacer is made from plastic, cardboard, or cork.

13. A shotgun shell with a chemiluminescent tracer for making shot projectiles visible to a shooter comprising:

(a) a hollow shotgun shell having a lower end and an upper end;

(b) a base with primer for ignition located inside the lower end of the shotgun shell;

(c) propellant positioned proximate to the primer inside the lower end of the shotgun shell;

(d) a shot cup holding shot pellets, the shot cup having a first end and an opposing second end, the shot cup located above the propellant with the second end of the shot cup proximate the propellant;

(e) a disk-shaped spacer positioned inside the first end of the shot cup and above the shot pellets held in the shot cup;

(f) a cylindrical ballistic tracer platform positioned inside the upper end of the shotgun shell and inside the first end of the shot cup, proximate to and above the spacer, the tracer platform comprising a resilient, elastic, translucent container holding a first reactant, a second reactant, a fluorescent dye, and means for physically separating the first reactant from the second reactant and the fluorescent dye prior to their combination resulting in a chemiluminescent reaction, the tracer platform moving separately from the shot cup after leaving a shotgun barrel.

14. The shotgun shell of claim 13 wherein the container is made from an elastic material selected from the group consisting of polypropylene, polyethylene, polycarbonate, and nylon.

15. The shotgun shell of claim 13 wherein the first reactant is a hydrogen peroxide solution and the second reactant is a phenyl oxalate ester solution.

16. The shotgun shell of claim 13 wherein the means for physically separating the first reactant from the second reactant and the fluorescent dye comprises at least one frangible glass container.

17. A shotgun shell having no shot, the shotgun shell having a tracer for making shot projectiles visible to a shooter comprising:

(a) a hollow shotgun shell having a lower end and an upper end;

(b) a base with primer for ignition located inside the lower end of the shotgun shell;

(c) propellant positioned proximate to the primer inside the lower end of the shotgun shell;

(d) a cylindrical wad having a first end and an opposing second end spaced from the second end, the second end of the wad positioned proximate to the propellant, the first end of the wad having a shot holder with petals, the shot holder containing no shot; and (e) a cylindrical ballistic tracer platform positioned inside the petals of the shot holder, the tracer platform comprising a resilient, elastic, translucent container holding a first reactant, a second reactant, a fluorescent dye, and means for physically separating the first reactant from the second reactant and the fluorescent dye prior to their combination resulting in a chemiluminescent reaction.

18. The shotgun shell of claim 17 wherein the container is made from a material selected from the group consisting of polypropylene, polyethylene, polycarbonate, and nylon.

19. The shotgun shell of claim 17 wherein the first reactant is a hydrogen peroxide solution and the second reactant is a phenyl oxalate ester solution.

20. The shotgun shell of claim 17 wherein the means for physically separating the first reactant from the second reactant and the fluorescent dye comprises at least one frangible glass container.

* * * * *